United States Patent [19]

Atkins

[11] 4,071,800

[45] Jan. 31, 1978

[54] THREE ELECTRODE ARC PLASMA FLAME IGNITION DEVICES

[75] Inventor: Francis James Atkins, Leamington Spa, England

[73] Assignee: Associated Engineering Limited, Leamington Spa, England

[21] Appl. No.: 741,696

[22] Filed: Nov. 15, 1976

[30] Foreign Application Priority Data

Dec. 5, 1975 United Kingdom ..... 50092/75

[51] Int. Cl.[2] ..... H01T 13/20; H01T 13/46

[52] U.S. Cl. ..... 313/123; 313/138; 313/142; 313/143

[58] Field of Search ..... 313/123, 124, 128, 136, 313/138, 139, 140–143; 123/143 B, 148 R, 148 C, 169 R, 169 MG

[56] References Cited

U.S. PATENT DOCUMENTS

| | | | |
|---|---|---|---|
| 3,842,818 | 10/1974 | Cowell et al. | 313/139 X |
| 3,842,819 | 10/1974 | Atkins et al. | 313/139 X |
| 3,911,307 | 10/1975 | Goto et al. | 313/141 X |

*Primary Examiner*—Siegfried H. Grimm

*Attorney, Agent, or Firm*—Brisebois & Kruger

[57] ABSTRACT

In a three electrode arc plasma flame ignition device, the first electrode surrounds the second electrode and the first and second electrodes define between them an annular gap across which the potential from a first source can be discharged, and the third electrode is surrounded by the second electrode and is so arranged that a higher potential applied to it discharges in series across a gap between the third electrode and the second electrode and radially across the annular gap between the second electrode and the first electrode.

4 Claims, 4 Drawing Figures

THREE ELECTRODE ARC PLASMA FLAME IGNITION DEVICES

Figure 1:
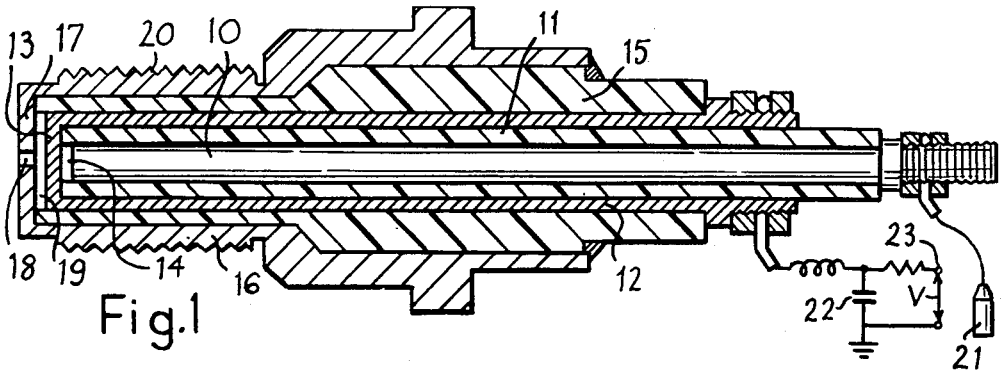

This invention relates to ignition devices of the kind producing an arc plasma flame, as distinct from conventional sparking plugs.

Devices of the aforementioned kind are described in our U.S. Pat. Nos. 3,842,818 and 3,842,819 and 3,988,646, and include a chamber having a wall, a hole in the wall through which a medium to be ignited may communicate with the inside of the chamber, and means to produce a plasma flame within the chamber of sufficient energy to project through the hole, wherein the means to produce the plasma flame includes first and second electrodes spaced apart by a gap such that a potential from a first source applied across the electrodes is insufficient to cause the breakdown of the gap, and a higher potential from a second source applied across the gap or part of the gap is sufficient to cause the potential from the first source to the discharged across the gap. Such devices will hereinafter be referred to as "of the kind described".

Known devices of the kind described have suffered from one or both of the defects that the rise of the higher potential applied across the gap is not sufficiently rapid, and that the gap across which the potential from the first source is discharged is between the same two points on the electrodes each time, so that wear of the electrodes results. An object of the present invention is simultaneously to reduce or eliminate both these defects.

According to the present invention, in an ignition device of the kind described, said first and second electrodes define between them an annular gap across which the potential from the first source is discharged, and there is provided a third electrode so arranged that the higher potential applied to it discharges across two gaps in series, from the third electrode to the second electrode and from the second electrode to the first electrode.

Preferably the first electrode is provided with a screw thread for insertion in a threaded hole, whereby the device is earthed, and the second electrode is intermediate the first and third electrodes.

In one embodiment, the first electrode has a substantially closed end, parallel to and spaced from the end part of the second electrode, defining a substantially closed, cylindrical chamber, the substantially closed end having a hole in its wall.

In another embodiment, the first electrode defines with the second electrode an annular chamber, the first electrode having an end part which surrounds the second electrode, and defines with it an annular hole.

Preferably, the first and second electrodes are annular, and are spaced apart by an annular insulator, and the third electrode is a central rod electrode.

Preferably also, the third electrode together with the second electrode and the insulator between them define a chamber containing the first series gap. In said one embodiment, the second series gap is in said cylindrical chamber, and in said other embodiment the second series gap is in said annular chamber.

Figure 2:
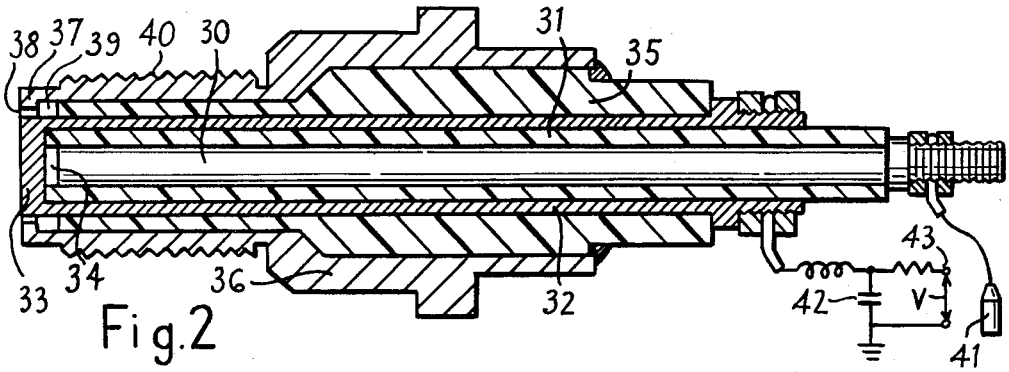
Figure 3:
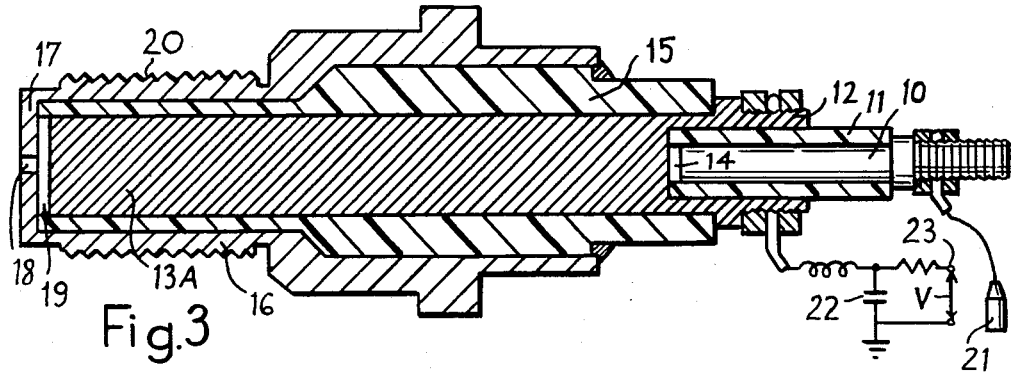
Figure 4:
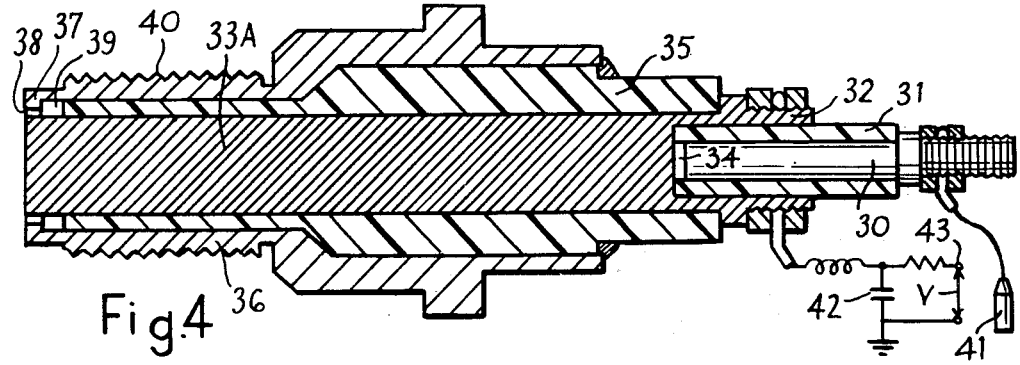

Embodiments of the invention will now be described by way of example with reference to the accompanying drawings, in which:

FIG. 1 is a diagrammatic longitudinal section of one ignition device in accordance with the invention, FIG. 2 is a similar view of a second ignition device, FIG. 3 is a modification of the device of FIG. 1, and FIG. 4 is a modification of the device of FIG. 2.

Referring to FIG. 1, the ignition device has a central rod electrode 10 (the third electrode), surrounded by an annular insulator 11. The insulator 11 is surrounded by an annular intermediate 12 (the second electrode), which has a closed end 13. The insulator 11 extends to the closed end 13 and is longer than the rod electrode 10, thus defining a closed chamber 14 bonded by the end of rod electrode 10, the bore of insulator 11, and the end 13 of the intermediate electrode 12.

The intermediate electrode 12 is surrounded by an annular outer insulator 15, which in turn is surrounded by an outer electrode 16 (the first electrode). The latter is annular, surrounds the insulator 15, and has a closed end 17 through which is formed a relatively small hole 18. A chamber 19 is formed between the closed end 13 of the intermediate electrode 12, the bore of insulator 15, and the end 17 of the outer electrode 16. The hole 18 communicates between the chamber 19 and the medium to be ignited.

In the embodiment described, electrode 16 is formed with an external screw thread 20, by which it may be screwed into the spark plug aperture of a reciprocating spark-ignition engine, or the corresponding aperture of a gas turbine, diesel engine, or other device, such as an oil burner, and thus the electrode 16 is effectively connected to earth potential. The rod electrode 10 is selectively connected to an extra-high-voltage source 21, e.g. a source at a potential of 5–30 kV, which, in a petrol engine, will be a timed source, and may use a conventional distributor and coil. The intermediate electrode 12 is connected to receive the discharge of a capacitor 22 which is connected between a high-potential source, e.g. a source 23 of 80 – 500 volts and earth.

In operation, the high potential is normally insufficient to break down the gap between intermediate electrode 12 and earthed electrode 16. However, when the extra high potential is applied to rod electrode 10, a spark occurs across chamber 14 to the intermediate electrode 12 and simultaneously across chamber 19 to discharge to earth on the outer electrode 16. This ionises the gas in chamber 19, and allows the capicitor 22 at high potential, connected to electrode 12, to discharge across chamber 19 in an arc, causing the gas in the chamber 19 to expand and causing an arch plasma to project through aperture 18 to ignite the external medium.

Referring to FIG. 2 the ignition device has a central rod electrode 30, surrounded by an annular insulator 31. The insulator 31 is surrounded by an annular intermediate electrode 32, which has a closed end 33 in contact with the medium to be ignited. The insulator 31 extends to the closed end 33 and is longer than rod electrode 30, defining a closed chamber 34 bounded by the end of the rod electrode 30, the bore of insulator 31, and the end 33 of the intermediate electrode 32.

The intermediate electrode 32 is surrounded by an annular outer, insulator 35, which in turn is surrounded by an outer electrode 36. The latter is annular, surrounds the insulator 35, and has an inturned end 37 which, with the end 33 of the intermediate electrode 32 defines an annular hole 38. The outer insulator 35 stops short of the end 37, thus defining an annular chamber 39 bounded by the insulator 35, electrode 32 and electrode 36, the annular hole 38 being small relative to the volume of the chamber 39 and preferably of smaller cross-section area than the cross-section of the chamber 39. The hole 38 communicates between the chamber 39 and the medium to be ignited. The outer electrode 36 may be formed with a screw thread 40, corresponding to screw thread 20 in FIG. 1, by which the electrode 36 is effectively at earth potential. The rod electrode 30 is selectively connected to an extra high voltage source 41, and the intermediate electrode 32 is connected to receive the discharge of a capacitor 42 which is connected between a high potential source 43 and earth.

The operation is similar to that described with reference to FIG. 1, but in this case when the EHT potential is applied to electrode 30 a spark occurs across chamber 34 and simultaneously across the annular hole 38 to the earth electrode. The gas in hole 38, between the end 33 of the intermediate electrode and the inturned end 37, is thus ionised, the capacitor 42 then discharges from electrode 32 to electrode 36 at earth potential, causing the gas in chamber 39 to be heated and expand and causing an arc plasma to project through the hole 38 to ignite the external medium.

It will be noted that the spark must first break-down the gap between the rod electrode 10, 30 and the respective intermediate electrode 12, 32. This ensures a rapid rise in voltage across the gap between the intermediate electrode 12, 32 and the respective earth electrode 16, 36. Moreover, in both embodiments, the gap between the intermediate and earth electrodes is annular, either from the end part 13 to the end part 17 around hole 18, or from end part 33 to end part 37 across hole 38. In both cases, if either electrode becomes pitted by wear, this causes the gap to increase at that point, and the discharge to take place at another point around the periphery of the hole 18, 38, thereby ensuring that the effects of wear are more evenly distributed around the periphery.

The ignition device of FIG. 3 is similar to that of FIG. 1 except that the central rod electrode 10 is shorter and the electrode 12, instead of having an end wall 13 has a rod-like portion 13A of the same diameter.

Likewise the device of FIG. 4 is similar to that of FIG. 2 except that the electrode 30 is shorter and the electrode 32, instead of having an end wall 33 has a rod-like portion 33A of the same diameter.

The operation of the devices of FIGS. 3 and 4 is exactly as described FIGS. 1 and 2.

It will be apparent that variations may be made within the scope of the invention. For example in the devices of FIGS. 2 and 4 the inturned end 37 may be replaced by a parallel end portion of the electrode 36.

I claim :

1. A three electrode arc plasma flame ignition device having an outer first electrode surrounding an intermediate second electrode and insulation between said first and second electrodes, a third electrode surrounded by said second electrode and insulation between said second and third electrodes, said first electrode having an end part which surrounds said second electrode and defines with it an annular gap across which a potential from a first source connected to said first and second electrodes is discharged when a higher potential from a second source is applied to said third electrode so that said higher potential discharges in series across a gap between the third electrode and the second electrode and radially across said annular gap between said second electrode and said first electrode.

2. An ignition device as claimed in claim 1, wherein said first electrode is provided with an external screw thread for insertion in a threaded hole, whereby the device is earthed, and said second electrode is intermediate said first and third electrodes.

3. An ignition device as claimed in claim 1, wherein said first and second electrodes are annular, and are spaced apart by an annular insulator, and said third electrode is a central rod electrode.

4. An ignition device as claimed in claim 1, wherein said third electrode together with said second electrode and the insulation between them define a chamber forming the first series gap.

* * * * *